US010005640B2

(12) United States Patent
Schroer et al.

(10) Patent No.: US 10,005,640 B2
(45) Date of Patent: Jun. 26, 2018

(54) ELEVATOR ALERT STATUS INDICATOR

(71) Applicant: CE Electronics, Inc., Bryan, OH (US)

(72) Inventors: Kevin Schroer, Bryan, OH (US); Charlie Simpkins, Ft. Wayne, IN (US)

(73) Assignee: C.E. Electronics, Bryan, OH (US)

( * ) Notice: Subject to any disclaimer, the term of this patent is extended or adjusted under 35 U.S.C. 154(b) by 0 days. days.

(21) Appl. No.: 15/270,388

(22) Filed: Sep. 20, 2016

(65) Prior Publication Data

US 2017/0081150 A1 Mar. 23, 2017

Related U.S. Application Data

(63) Continuation of application No. 62/222,392, filed on Sep. 23, 2015.

(51) Int. Cl.
*B66B 5/00* (2006.01)
*B66B 1/34* (2006.01)

(52) U.S. Cl.
CPC ..... *B66B 5/0018* (2013.01); *B66B 1/3446* (2013.01)

(58) Field of Classification Search
CPC ..... B66B 5/0018; B66B 1/3446
USPC ..... 187/390
See application file for complete search history.

(56) References Cited

U.S. PATENT DOCUMENTS 4,630,026 A * 12/1986 Lewis ..... B66B 3/023 187/399
5,197,570 A * 3/1993 Matsui ..... B66B 9/003 187/249
5,253,734 A * 10/1993 Laurutis ..... A62B 1/02 187/239
5,821,478 A 10/1998 Schroder-Brumloop et al.
5,955,710 A * 9/1999 DiFranza ..... B66B 1/34 187/247
5,979,607 A * 11/1999 Allen ..... B66B 5/024 187/384
8,418,815 B2 4/2013 Encinas Carreno et al.
8,719,037 B2 * 5/2014 Gazdzinski ..... G06Q 30/0251 187/396
8,738,276 B1 * 5/2014 Boss ..... B61L 27/04 455/404.1
2002/0129995 A1 * 9/2002 Friedli ..... B66B 3/00 187/392
2003/0057029 A1 * 3/2003 Fujino ..... B66B 3/00 187/391
2006/0201751 A1 * 9/2006 Kawai ..... B66B 5/024 187/313
2008/0196978 A1 * 8/2008 Siikonen ..... B66B 5/022 187/384
2011/0240414 A1 * 10/2011 Carreno ..... B66B 5/0025 187/390
2013/0001022 A1 1/2013 Marien et al.
(Continued)

*Primary Examiner* — David Warren

(74) *Attorney, Agent, or Firm* — Schaffer, Schaub & Marriott, Ltd.

(57) ABSTRACT

This unique Elevator Alert Status Indicator (EASI) system monitors a number of elevators for different error conditions. If a problem occurs, a pictorial representation of the problem will be shown on a screen, along with an alphanumeric elevator location. This system will also sound an alarm for certain high importance problems to get the attention of maintenance and other staff of the building. However, any fault condition can be chosen to sound an alarm.

9 Claims, 3 Drawing Sheets

ELEVATOR ALERT STATUS INDICATOR (EASI)

(56) References Cited

U.S. PATENT DOCUMENTS

| | | | | |
|---|---|---|---|---|
| 2015/0048953 | A1* | 2/2015 | Murphy, Jr. | G08B 25/14 340/691.6 |
| 2015/0114763 | A1* | 4/2015 | Kim | B66B 5/0012 187/392 |
| 2015/0316410 | A1* | 11/2015 | Collins | G01V 8/10 702/104 |
| 2016/0130114 | A1* | 5/2016 | Wilke | B66B 5/0025 187/393 |
| 2017/0036887 | A1* | 2/2017 | Roberts | B66B 1/30 |
| 2017/0045493 | A1* | 2/2017 | van der Woude | B66B 7/1215 |
| 2017/0073187 | A1* | 3/2017 | Youker | B66B 3/008 |
| 2017/0073193 | A1* | 3/2017 | Kuczek | B66B 11/0407 |
| 2017/0081150 | A1* | 3/2017 | Schroer | B66B 5/0018 |
| 2017/0107080 | A1* | 4/2017 | Steinhauer | B66B 9/003 |
| 2017/0109132 | A1* | 4/2017 | Gazdzinski | G06F 3/167 |

* cited by examiner

ELEVATOR ALERT STATUS INDICATOR

CROSS REFERENCE TO RELATED APPLICATION

This application claims the benefit of U.S. provisional patent application Ser. No. 62/222,392 filed on Sep. 23, 2015.

TECHNICAL FIELD

This invention relates to a unique Elevator Alert Status Indicator (EASI) system. The EASI system monitors a number of elevators for different error conditions.

BACKGROUND OF THE INVENTION

There are known devices that diagnose situations in an elevator system. The devices are capable of recording and providing some form of visible indication regarding the recording. For example, some known devices provide a graphical output indicating parameters detected by the device.

Those skilled in the art are always striving to make improvements. It would be useful to provide enhanced capabilities for monitoring in elevator systems and to improve efficiencies associated with diagnosing and correcting or servicing elevator system components.

It would be desirable to have a signaling device to automatically warn elevator passengers and maintenance personnel when a problem arises. Thus an elevator alert solving the aforementioned problem is desired.

SUMMARY OF THE INVENTION

This Elevator Alert Status Indicator (EASI) system monitors a number of elevators for different error conditions. If a problem occurs, a pictorial representation of the problem will be shown on a screen, along with an alphanumeric elevator location. This system will also sound an alarm for certain, high importance problems to get the attention of maintenance and other staff of the building. If multiple problems are occurring at once, a number will appear at the top of the screen to show that there is more than one thing wrong. By default, the issue with the highest priority (which may be assigned in the field) will appear, and the problems with less priority may be viewed by pressing a button.

Each unit is able to support up to 8 elevators and 8 different error types, as limited by the auxiliary input boards. The EASI utilizes a Controller Area Network (CAN) protocol to communicate between the input boards and display. Each input board is addressed as certain error type, while the discrete inputs on the hoard are for the different elevators in a group.

Other objects and advantages of the present invention will become apparent to those skilled in the art upon a review of the following detailed description of the preferred embodiments and the accompanying drawings.

IN THE DRAWINGS

DETAILED DESCRIPTION OF THE INVENTION

Figure 1:
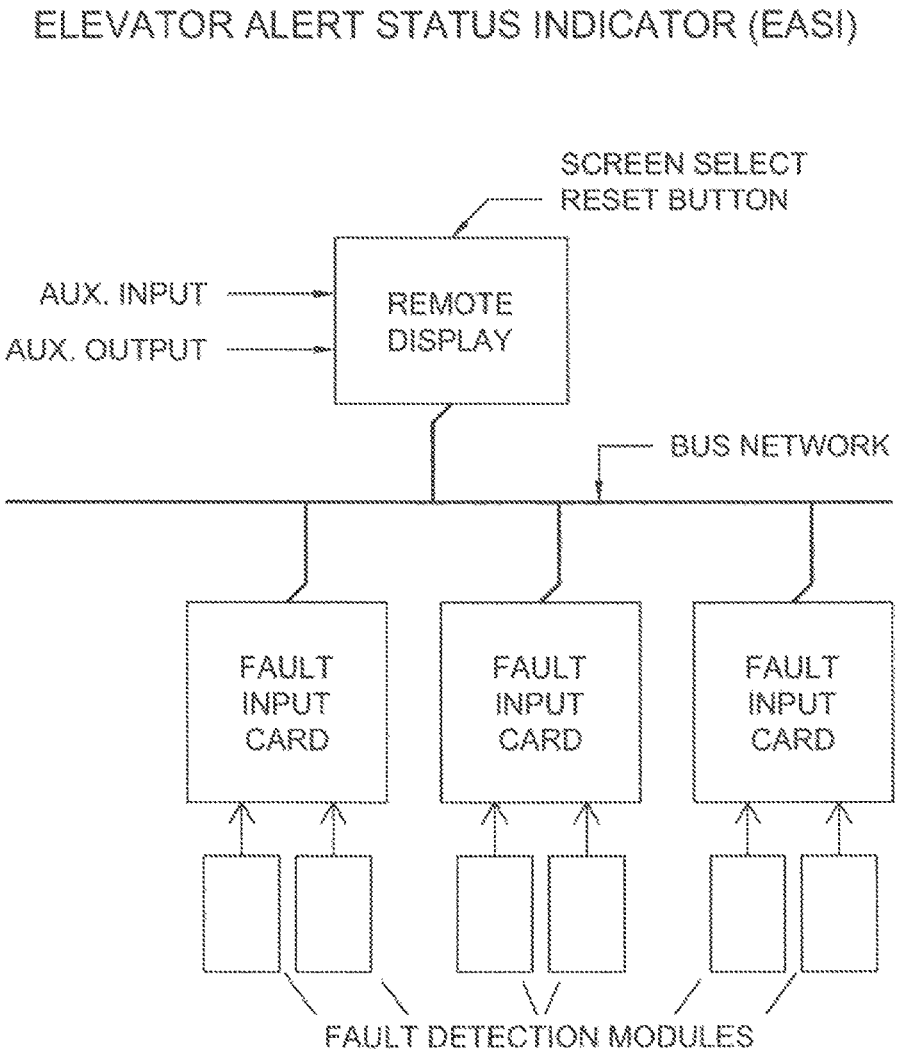
FIG. 1 is a simplified block diagram of EASI apparatus in accordance with an embodiment of the present invention.

FIG. 1 shows a simplified block diagram of EASI apparatus in accordance with an embodiment of the present invention. The EASI system is for monitoring an elevator arrangement. The EASI system includes a detector arranged to detect an event or a condition in, on or near an associated elevated car; and a monitoring device that is configured to monitor a status of the elevator arrangement. The system communicates with the detector for receiving data indicative of any event or condition detected by the detector, and provides an output that associates the monitored status of the elevator arrangement at a time of any detected event or condition with an indication of the defected event or condition that can be communicated to a location remote from the monitoring device, the reproduction including a visual output indicative of the detected event and a corresponding audible output of the same sound.

The Elevator Alert Status Indicator (EASI) is a multi-function display that is able to be mounted in new or existing hall button stations. This small display is able to monitor a number of elevators for different error conditions. If a problem occurs, a pictorial representation of the problem will be shown on a colored screen, along with an alphanumeric elevator location. This indication will stay on the screen until the fault or faults are repaired. This system will also sound an alarm if the fault is of high importance. This will audibly get the attention of maintenance and other staff of the building. The alarm can be silenced but will alarm again at a defined programmed duration of time if the fault is not fixed. Being located in the half station makes installation inexpensive because there is no need for an additional fixture as every building already has a hall button fixture requirement.

Preferably, the pictorial representation of the highest priority fault is presented in color. The preferred color is red. The color also may be a highly visible color such as neon green or neon orange.

In one embodiment, an alarm sounds on high priority errors. In another embodiment, the determination of which fault conditions cause an alarm to sound can be set and changed in the field. In this way, any fault condition can be chosen to cause an alarm to sound. There is no limit to how many different conditions can sound this alarm. It can be chosen to have every fault cause an alarm, no faults cause an alarm, or anywhere in between.

Figure 2:
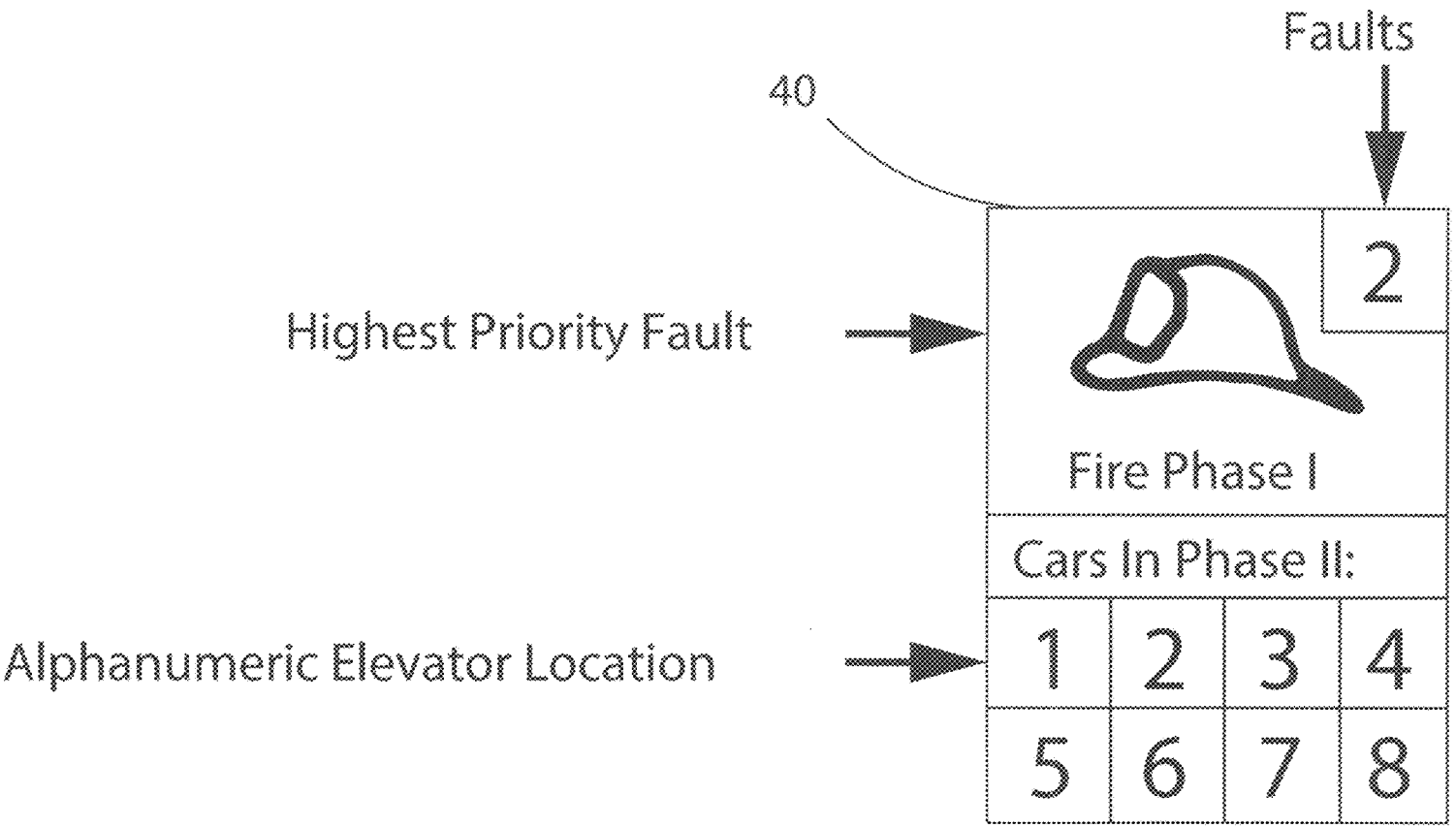
FIG. 2 is an illustration of a typical EASI display.

FIG. 2 is an illustration of a typical EASI display.

Figure 3:
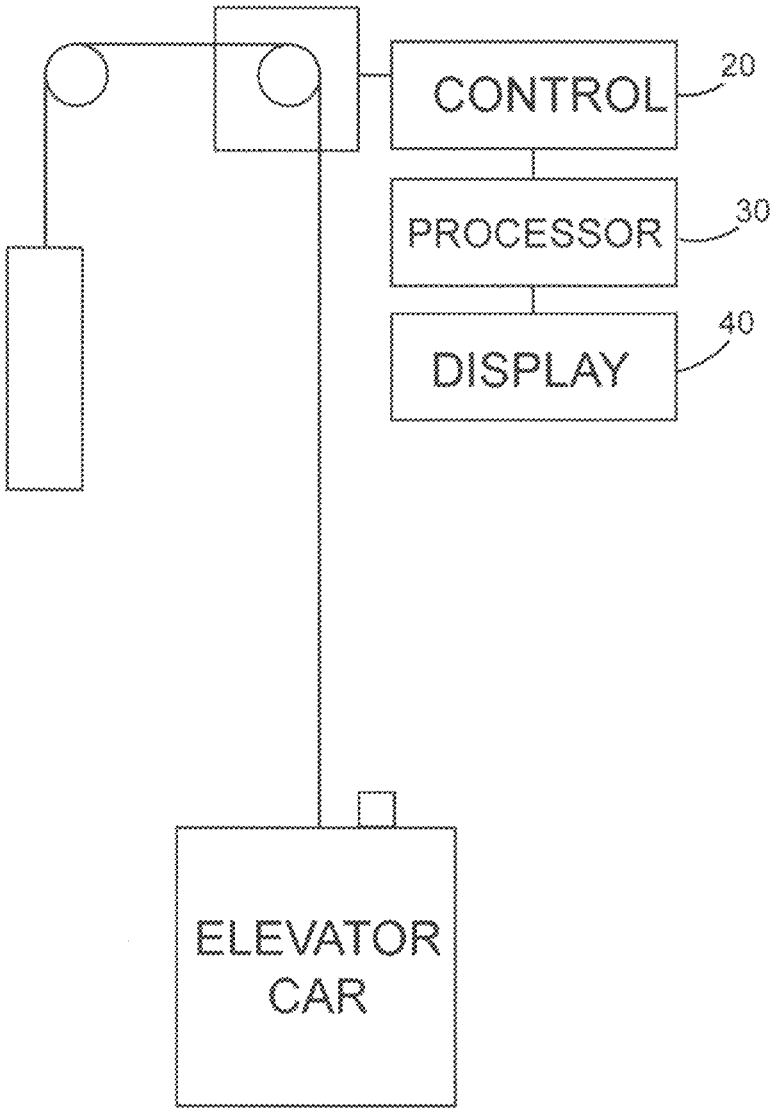
FIG. 3 is an illustration of a conventional elevator using the EASI system of this invention.

FIG. 3 is an illustration of a conventional elevator using the EASI system of this invention. Shown is detector 10 mounted on the elevator car. Also shown is control 20, processor 30, and display 40.

If multiple faults are occurring at once, a number will appear at the top of the screen to show that there is more than one thing wrong. The fault with the highest priority will appear on the screen. All faults can be reviewed in order of importance. During the review you will see the cause for the fault and the elevators with the fault.

Each unit is able to support multiple elevators and multiple error types. The EASI system utilizes a serial Network protocol to communicate between the input boards and the display. Each input board is addressed to ascertain the error type, and which elevator in the group is causing the error. The system can handle multiple errors and faulty elevators at the same time.

Common Faults and indications displayed but not limited to:

Water in Pit
Cab Light Fault
Phone Line Fault
Fire Phase 1
Fire Phase 2
Fire Jewel Indication
Emergency Power The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. An EASI system for monitoring an elevator arrangement, comprising:

a detector arranged to detect an event or a condition in, or near an associated elevator car; and a processor that is configured to monitor a status of the elevator arrangement, by communicating with the detector for receiving data indicative of any event or condition detected by the detector, a display that provides an output that associates the monitored status of the elevator wherein the processor at a time of any detected event or condition with an indication of the detected event or condition that is communicated to the display at a location remote from the processor, wherein the display is a visual output indicative of the detected event and a corresponding audible output of a detected sound, and a control that operates the elevator wherein the processor also provides an output to the control that operates the elevator.

2. The EASI system of claim 1, wherein the processor determines a baseline reference of et least one acceptable event or condition:

determines whether any detected event or condition has en expected relationship with a corresponding acceptable event or condition; and provides the output to the other device responsive to the detected event or condition not having the expected relationship with the corresponding acceptable event or condition.

3. The EASI system of claim 1, wherein:

the processor receiving the output from the detector generates a corresponding output that provides the reproduction of the detected event or condition.

4. The EASI system of claim 3, wherein the processor generates an audible output representing a detected sound and a visible output representing the detected sound in association with the status of the elevator arrangement at the time of the detected sound.

5. The EASI system of claim 4, wherein one of the monitoring device or the processor digitizes the indication of the detected sound such that the corresponding sound file is digitized.

6. The EASI system of claim 1 further comprising multiple input boards configured to support multiple elevators and configured to detect multiple different error events and further comprising a Controller Area Network (CAN) protocol configured to communicate between the input boards and a visual output.

7. The EASI system of claim 6 wherein each of the input boards is configured to address a certain error type.

8. The EASI system of claim 7 wherein each of the input boards also is configured to address different elevators in a group.

9. The EASI system of claim 6 wherein the multiple input boards are configured to prioritize the multiple different error events.

* * * * *